US008565651B2

(12) United States Patent
Fujii

(10) Patent No.: US 8,565,651 B2
(45) Date of Patent: Oct. 22, 2013

(54) TONER SUPPLY DEVICE AND IMAGE FORMING APPARATUS

(75) Inventor: Hirokazu Fujii, Osaka (JP)

(73) Assignee: Kyocera Documents Solutions Inc., Osaka (JP)

( * ) Notice: Subject to any disclaimer, the term of this patent is extended or adjusted under 35 U.S.C. 154(b) by 319 days.

(21) Appl. No.: 13/039,675

(22) Filed: Mar. 3, 2011

(65) Prior Publication Data

US 2011/0236076 A1 Sep. 29, 2011

(30) Foreign Application Priority Data

Mar. 25, 2010 (JP) ..... 2010-069987

(51) Int. Cl.
*G03G 15/08* (2006.01)

(52) U.S. Cl.
USPC ..... 399/262; 399/120; 399/119; 399/106; 399/11

(58) Field of Classification Search
USPC ..... 399/262, 120, 119, 106, 11, 25
See application file for complete search history.

(56) References Cited

U.S. PATENT DOCUMENTS

2007/0077097 A1* 4/2007 Watanabe et al. ..... 399/258
2009/0016779 A1* 1/2009 Hwang ..... 399/258

FOREIGN PATENT DOCUMENTS

| | | |
|---|---|---|
| JP | 62-121227 | 8/1987 |
| JP | 08-234593 | 9/1996 |
| JP | 2000-275944 | 10/2000 |
| JP | 2007-101710 | 4/2007 |

* cited by examiner

*Primary Examiner* — Walter L Lindsay, Jr.
*Assistant Examiner* — Roy Y Yi
(74) *Attorney, Agent, or Firm* — Dilworth & Barrese, LLP.

(57) ABSTRACT

A toner supply device configured to be detachably attached into an apparatus main body of an image forming apparatus and supplying a toner to a developing device, the toner supply device being: provided with a container main body configured substantially in a rectangular solid shape and configured to be inserted into the apparatus main body along a longitudinal direction of the container main body, having a toner containing part communicating with a developing device, and a barrel part that moves downward upon receipt of a biasing force from a direction of the apparatus main body when being inserted into the apparatus main body and a lock part arranged at a rear of the barrel part; the handle member being inserted into said apparatus main body side according to the downward movement of said barrel part and fixing said toner supply device in said apparatus main body.

9 Claims, 10 Drawing Sheets

TONER SUPPLY DEVICE AND IMAGE FORMING APPARATUS

This application is based on and claims the benefit of priority from Japanese Patent Application No. 2010-069987, filed on 25 Mar. 2010, the content of which is incorporated herein by reference.

BACKGROUND OF THE INVENTION

1. Field of the Invention

This disclosure relates to a toner supply device used in an image forming apparatus such as a copier, a printer, a facsimile machine and the like and an image forming apparatus provided with the same.

2. Related Art

Hitherto, in this type of image forming apparatus, image formation using a toner is performed. Specifically, first, the toner is supplied from a developing device to a photosensitive drum so that a toner image is formed, and the formed toner image is transferred and fixed on a paper.

Here, the toner consumed in forming the image needs to be supplied separately. Then, for supply of the toner, a technology of using a cartridge-type toner supply device has been proposed.

In the image forming apparatus using the cartridge-type toner supply device as above, a spent toner supply device is removed from an apparatus main body of the image forming apparatus by a user or the like, and a new toner supply device is attached to the apparatus main body.

SUMMARY OF THE INVENTION

However, the above prior-art technology has a problem that the number of components of the toner supply device, which is a consumable supply, cannot be reduced.

That is, the above-described toner supply device needs a rotating lever member and a lock mechanism using an elastic force of a resin for a lock that fixes the toner supply device in the apparatus main body. Also, if the lock mechanism using the elastic force of a resin is provided, there is a concern that the lock mechanism might be deformed or broken.

As described above, from the viewpoint that the toner supply device is a consumable supply, in order to reduce the manufacturing cost, it is preferable that a configuration of the toner supply device is simplified and a configuration required for fixation of the toner supply device into the apparatus main body is installed on the apparatus main body side. However, in the prior-art technology-provided with a lever member and the like, special consideration is not given to this point.

Thus, an object of this disclosure is to solve the above problem and to provide a toner supply device that can reduce the number of components in the toner supply device and an image forming apparatus provided with the same.

A first aspect of the present invention to achieve the above object is a toner supply device configured to be detachably attached into an apparatus main body of an image forming apparatus and supplying a toner to a developing device, the toner supply device including a container main body configured substantially in a rectangular solid shape and inserted into the apparatus main body along a longitudinal direction of the container main body and having a toner containing part communicating with the developing device and a barrel part which receives a biasing force from a direction of the apparatus main body when being inserted into the apparatus main body and moved downward and a handle member, arranged at a rear of said barrel part when seen from an insertion direction in which said container main body is inserted, having a lock part being inserted into said apparatus main body side according to the downward movement of said barrel part and fixing said toner supply device in said apparatus main body.

DETAILED DESCRIPTION OF THE INVENTION

A preferred embodiment of this disclosure will be described below using the attached drawings.

Figure 1:
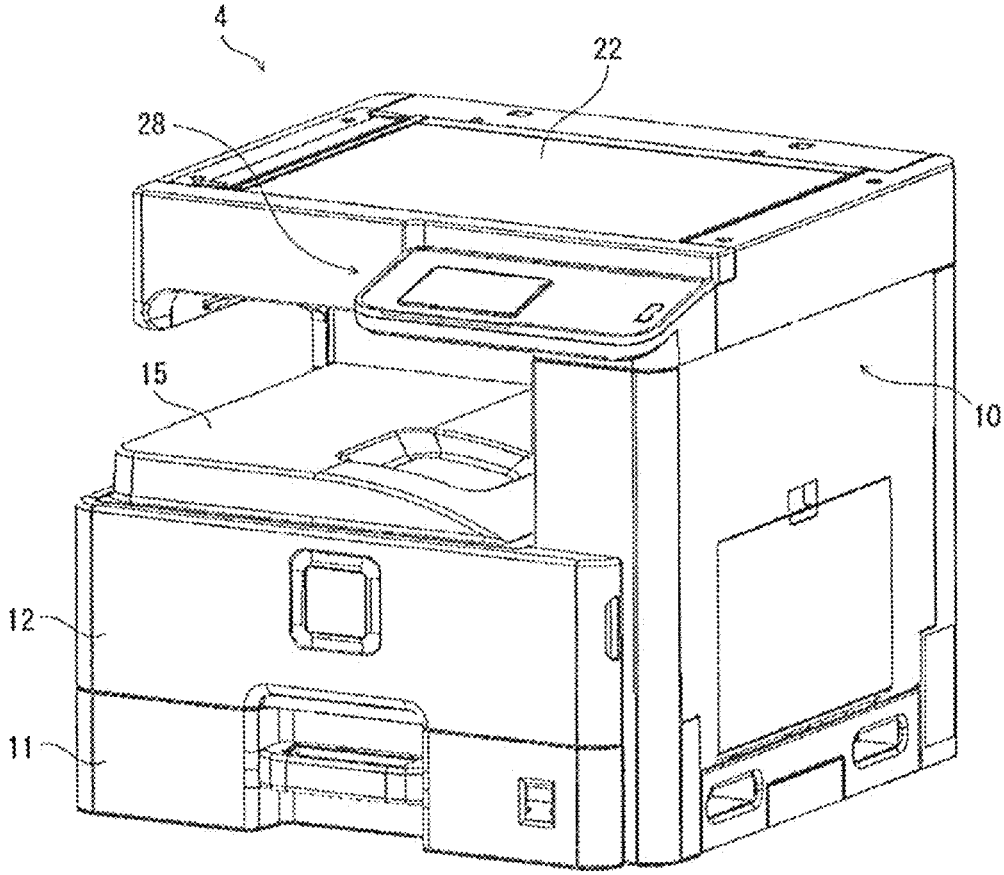
FIG. 1 is an appearance perspective view of a composite machine of this embodiment.

FIG. 1 illustrates a digital composite machine, which is an example of an image forming apparatus or so-called multi-functional peripheral (hereinafter referred to as MFP) 4, when viewed from an upper right front position. In FIG. 1, a front face of the MFP 4 opposing a user and a right side face of the MFP 4 are seen. The MFP 4 is provided with an apparatus main body 10 of an intra-barrel paper ejection type. On the upper part of a front cover 12 of the apparatus main body 10, a paper ejecting tray 15 is disposed.

On the upper part of the paper ejecting tray 15, an optical scanner part 22 is disposed. Though not shown in FIG. 1, above the scanner part 22 of this embodiment, a document holder 23 is arranged (see FIG. 3). A document placed on the scanner part 22 and held by the document holder 23 is optically read by the scanner part 22. On the upper part of the paper ejecting tray 15, an automatic document feeder may be arranged instead of the document holder 23.

In front of the scanner part 22, an operation panel 28 is disposed. In the operation panel 28, a plurality of operation keys used for various operations to be operated by the user and a display screen that displays various types of information are disposed. Information relating to the fact that the user has operated them is notified to a controller 18 shown in FIG. 2.

On the other hand, in the apparatus main body 10, below the front cover 12, a paper supply device 11 is arranged. The paper supply device 11 of this embodiment is capable of being withdrawn to the front side shown in FIG. 1 and also of being pushed into the back side. Inside this paper supply device 11, a plurality of sheets are stacked in a thickness direction and are accommodated. These sheets are fed out one by one to the right shown in FIG. 1 from the paper supply device 11 and conveyed upward along the right side face of the MFP 4.

Figure 2:
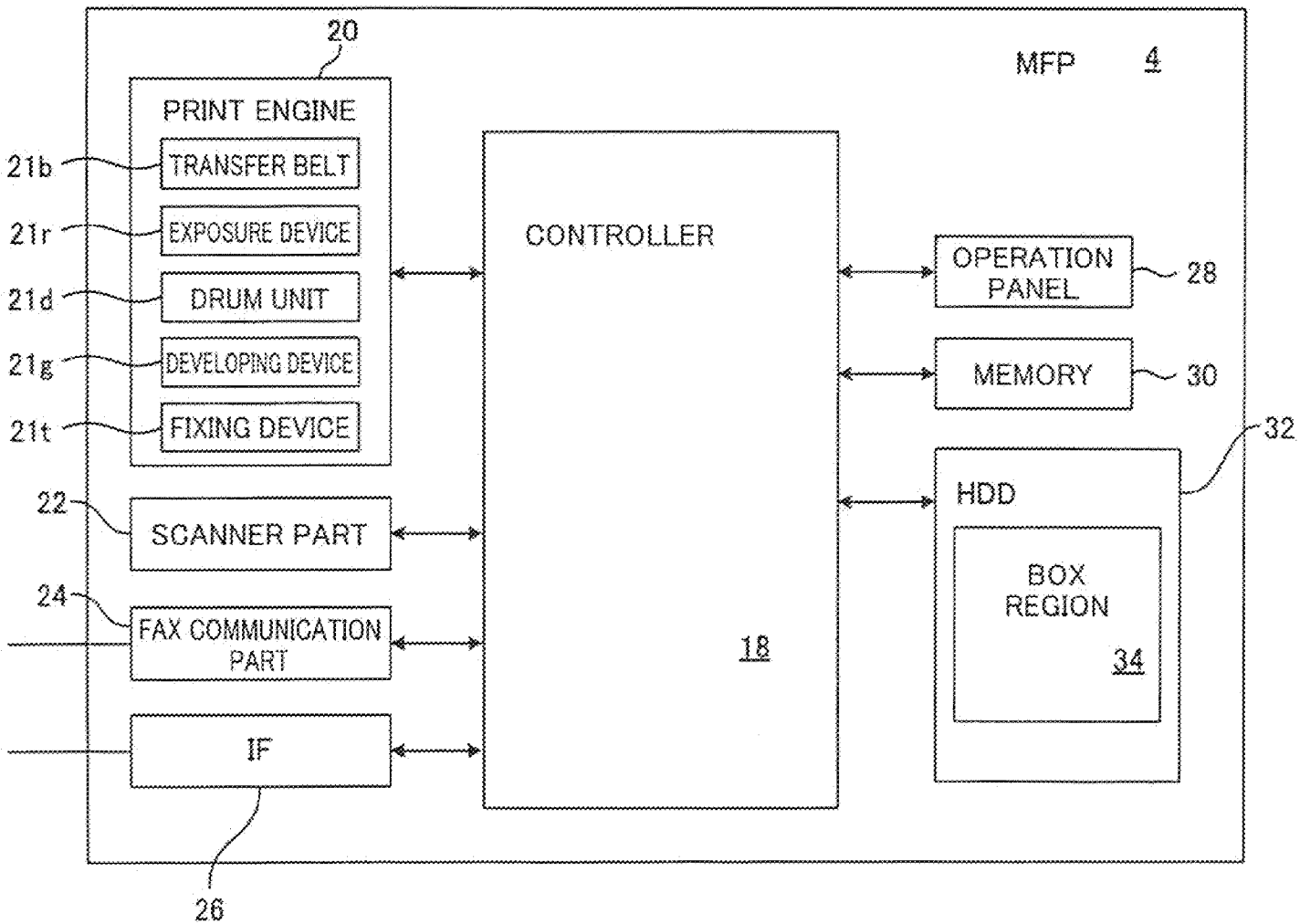
FIG. 2 is a configuration diagram of the composite machine in FIG. 1, including a controller.

FIG. 2 is an outline configuration diagram including the controller 18 of the MFP 4. The MFP 4 is connected to a network through a network interface (IF) 26 and moreover connected to a public line. Then, the MFP 4 performs various operations in accordance with an instruction of a program.

The MFP 4 is provided with the controller 18, the IF 26, a HDD 32, a memory 30, a FAX communication part 24, a print engine 20, the scanner part 22, and the operation panel 28. And the MFP 4 has a printing function (Copy function), a transmission function (Send function), and a storage function (Box function), for example.

Specifically, the HDD 32 is provided with a box region 34 so as to sequentially store various data such as a print job transmitted from a client PC, a scan job read by the scanner part 22, a facsimile job received by the FAX communication part 24 and the like and has the Box function.

The memory 30 has a ROM, a RAM and the like, and a program for various processing operations and the like are stored in the memory 30.

The above-described FAX communication part 24 also has the Send function and transmits the facsimile job stored in the HDD 32 to the other party.

Also, the print engine 20 is connected to a drum unit 21*d* that forms an electrostatic latent image by light radiated from an exposure device 21*r*, a developing device 21*g* that develops a toner image, a transfer belt 21*b* that transfers the toner image onto the paper and the like, in addition to the scanner part 22 and the paper supply device 11. And the print engine 20 has the Copy function that outputs the print job or the like stored in the HDD 32 to the paper and ejects the paper to the paper ejecting tray 15.

The print engine 20 of this embodiment is capable of color printing. In the drum unit 21*d*, four photosensitive drums, for example, are arranged. In each of these photosensitive drums, electrostatic latent images for yellow, magenta, cyan, and black are formed, respectively. Thus, as shown in FIG. 3, four toner containers (toner supply devices) 70 are arranged inside the apparatus main body 10.

Figure 3:
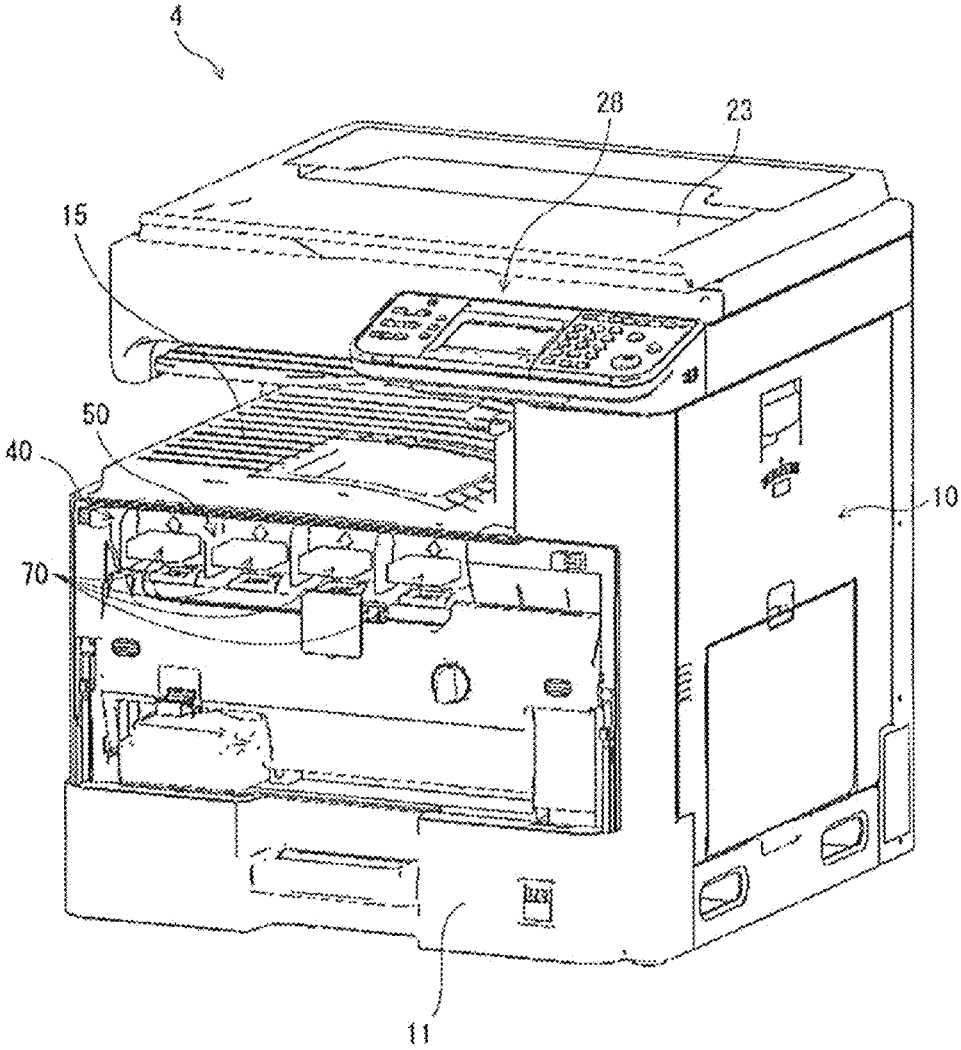
FIG. 3 is a perspective view of a state in which a front cover is removed from the composite machine in FIG. 1.

In more detail, in FIG. 3, the four toner containers 70 that supply toners for yellow, magenta, cyan, and black, respectively, are shown in the order from the left. The toner in each color is supplied to the drum unit 21*d* through the developing device 21*g*, and a toner image of each color is developed on the photosensitive drum, respectively. Each of these toner images is primarily transferred to the transfer belt 21*b* and then, secondarily transferred onto the paper fed upward on the right side face of the MFP 4. Subsequently, the toner image which has been secondarily transferred onto the paper is fixed on the paper by a fixing device 21*t* shown in FIG. 2, and the paper on which the toner image has been fixed is ejected to the paper ejecting tray 15.

The four toner containers 70 can be detachably attached to the apparatus main body 10 and the four toner containers 70 are configured capable of being pushed into and withdrawn from along a direction connecting the front side and the back side in the MFP 4 shown in FIG. 3.

Figure 4:
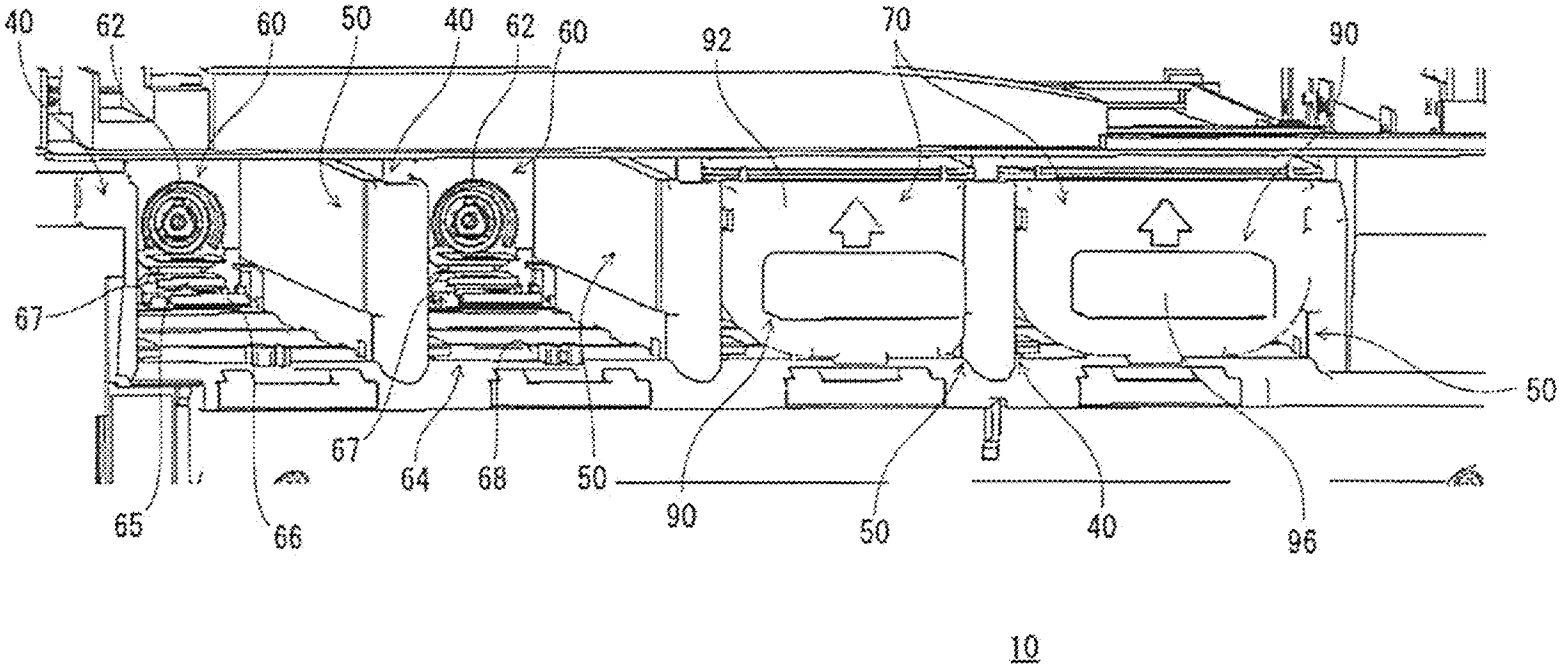
FIG. 4 is an enlarged perspective view of the vicinity of a toner container in FIG. 3.

Specifically, as shown in FIG. 4, inside the apparatus main body 10, rail members 40 and 50 are arranged. The rail member 40 is arranged on the left side of each toner container 70 when seen from the front of the MFP 4, while the rail member 50 is arranged on the right side of each toner container 70, respectively. Then, a pair of the rail members 40 and 50 guides movement of the toner container 70 which is pushed into and withdrawn from between the pair of rail members 40 and 50. Details of these rail members 40 and 50 will be described later referring to FIGS. 8 to 10.

In FIG. 4, the toner container 70 for black located on the rightmost side and the toner container 70 for cyan located on the left side thereof are arranged between the rail members 40 and 50. Also, in FIG. 4, between the rail members 40 and 50 that guide the movement of the toner container 70 for magenta located on the left side of the toner container 70 for cyan and the toner container 70 for yellow located on the leftmost side, a distal-end opposing surface 60 of the apparatus main body 10 and a container placement surface 64 are shown, respectively.

Figure 5:
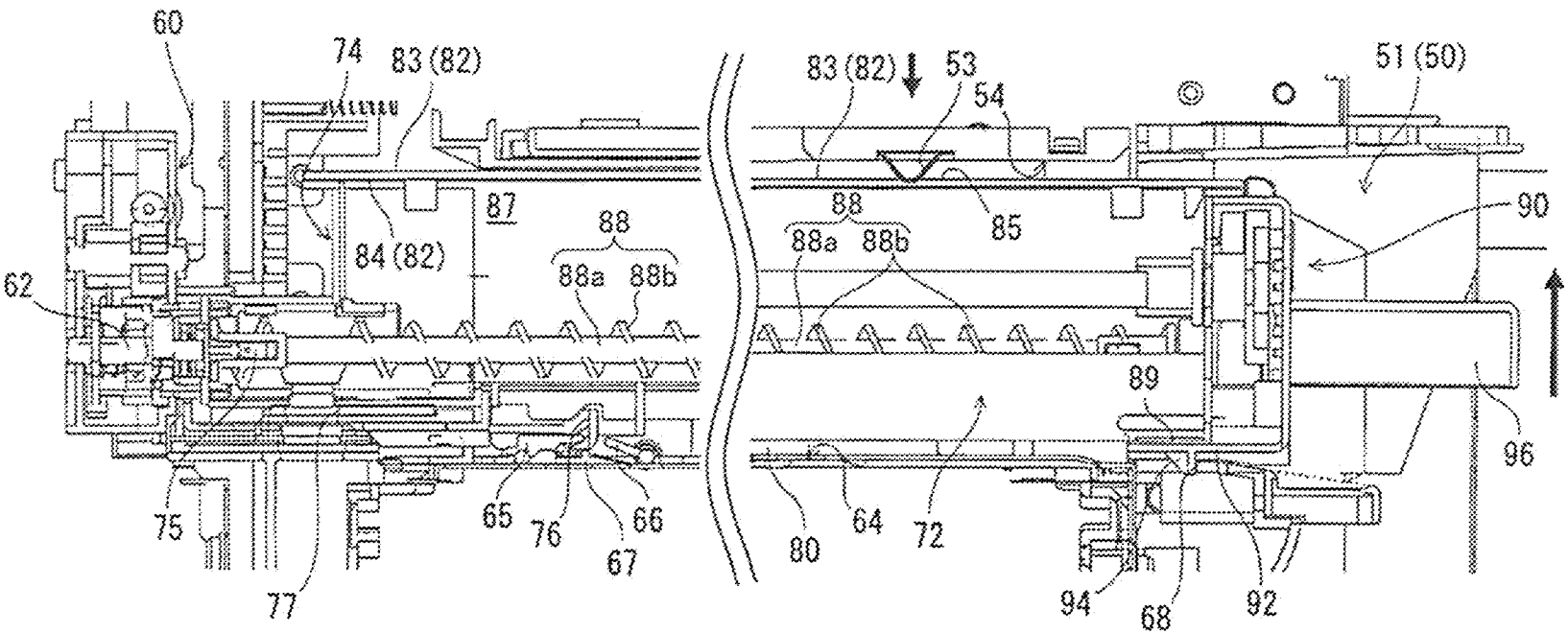
FIG. 5 is a sectional view of the vicinity of the toner container in FIG. 4.

The distal-end opposing surface 60 extends vertically on the back side of the apparatus main body 10 and as shown in FIG. 5, opposes an insertion distal-end part 74 of the toner container 70. Also, on the distal-end opposing surface 60, a driving coupling 62 on the apparatus main body 10 side is disposed.

The container placement surface 64 extends horizontally from the back side to the front side of the apparatus main body 10 and supports the lower side of the toner container 70. At an appropriate position on the back side of the apparatus main body 10 in the container placement surface 64, a shutter opening part 65 that opens a shutter 76 of the toner container 70, which will be described later, and a shutter closing part 66 located on the front side of the shutter opening part 65 are disposed as shown in FIG. 5.

In FIG. 4, on the left side of the shutter opening part 65 and the shutter closing part 66 (see FIG. 5), a groove part 67 is formed. The groove part 67 is engaged with a key-shaped part 86, which will be described later using FIG. 7.

Also, on each container placement surface 64, on the front side of the apparatus main body 10, an engagement recess part 68 is formed (see FIG. 5). The engagement recess part 68 is formed in the shape recessed downward and used for fixation of the toner container 70 to the apparatus main body 10.

The toner container 70 in this embodiment is inserted into the apparatus main body 10 in the same direction as the insertion direction of the above-described paper supply device 11.

Figure 6:
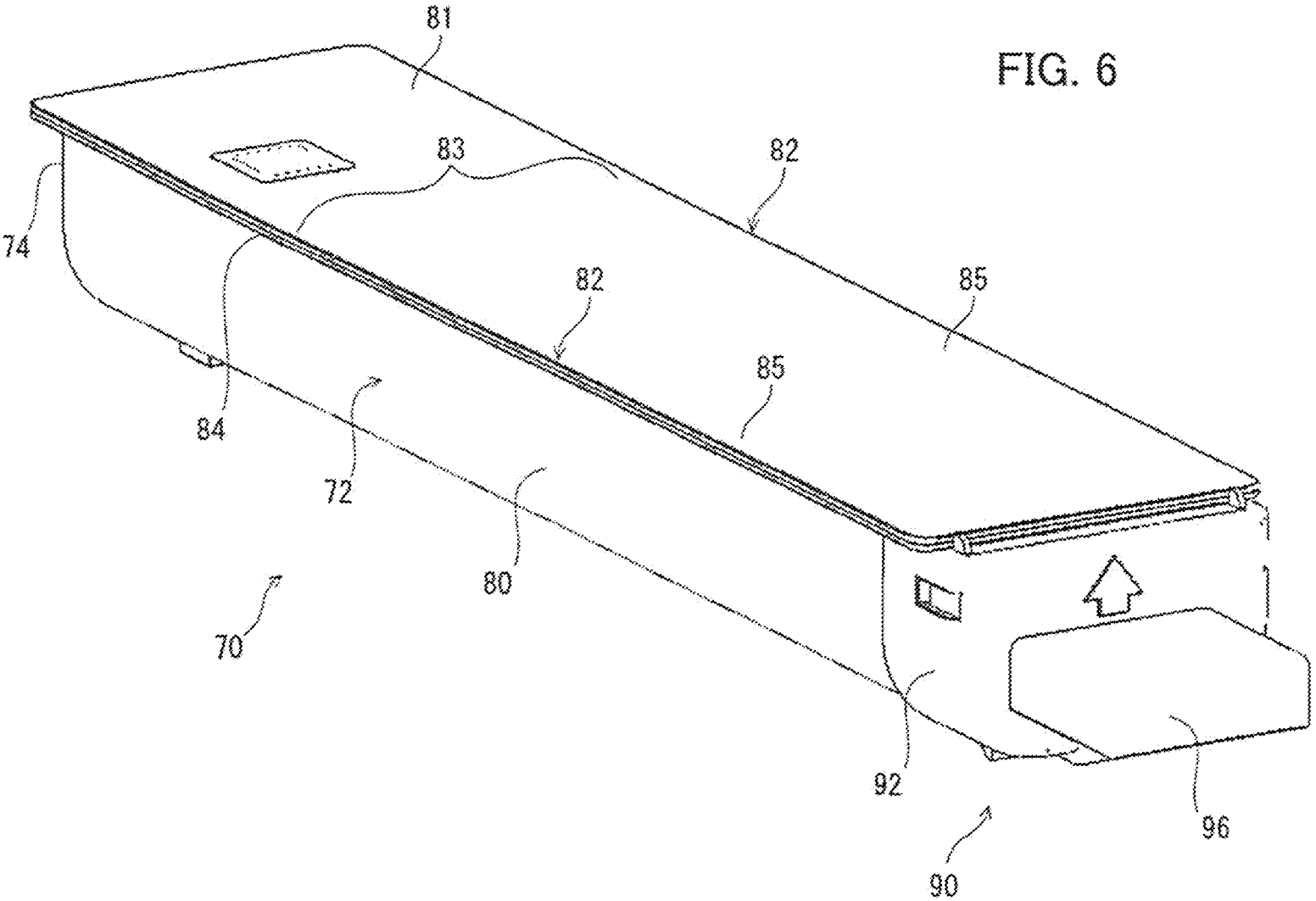
FIG. 6 is an appearance perspective view of the toner container in FIG. 4.
Figure 7:
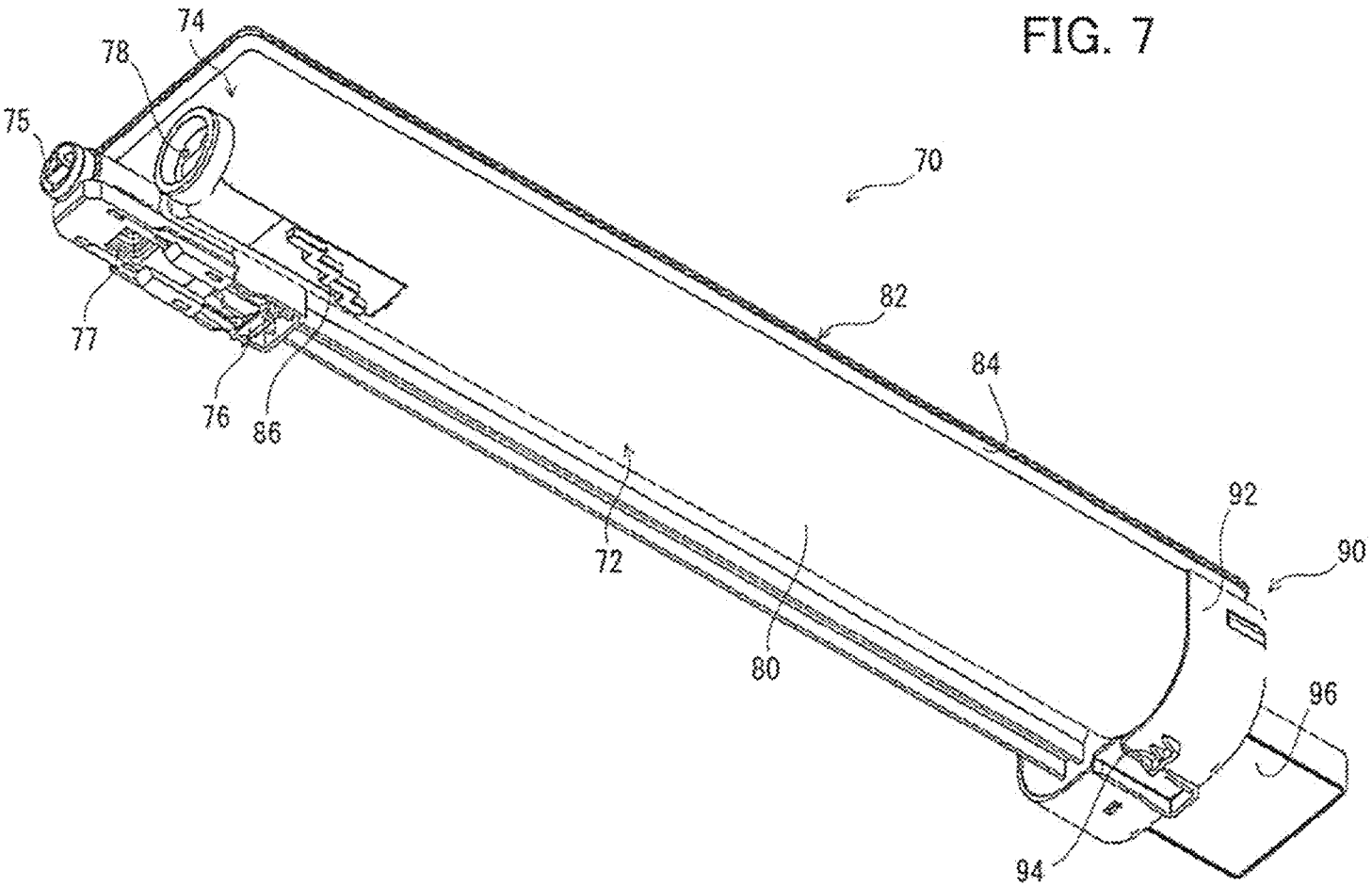
FIG. 7 is an appearance perspective view of the toner container in FIG. 4.

Specifically, as shown in FIGS. 6 and 7, the toner container 70 is provided with a container main body 72 configured substantially in a rectangular solid shape. The container main body 72 has, in the following order when seen from the insertion direction, the insertion distal-end part 74, a barrel part 80, and a handle engagement part 89 (see FIG. 5) located at the rear of the barrel part 80.

In more detail, the insertion distal-end part 74 is located at the distal end of the longitudinal container main body 72 and has a driving coupling 75 on the projecting container main body 10 side (see FIGS. 5 and 7). The driving coupling 75 is connected to the driving coupling 62 on the apparatus main body 10 side when the toner container 70 is attached to the apparatus main body 10. Also, below the driving coupling 75, a toner supply port 77 is disposed. The toner supply port 77 is opened/closed by the shutter 76.

That is, if the toner container 70 is pushed in horizontally toward the back side of the apparatus main body 10, the shutter 76 is brought into contact with the shutter opening part 65 and moved in a direction opposite to the insertion direction of the toner container 70 the withdrawing direction of the toner container 70). As a result, as shown in FIGS. 5 and 7, the toner supply port 77 is opened, and a toner containing part 87 (see FIG. 5) in the container main body 72 and the developing device 21*g* are made to communicate with each other.

On the other hand, if the toner container 70 is withdrawn horizontally toward the front side of the apparatus main body 10, the shutter 76 is brought into contact with the shutter closing part 66 and moved in a direction opposite to the withdrawing direction of the toner container 70 (the insertion direction of the toner container 70), and thus, the toner supply port 77 is closed. In the insertion distal-end part 74, in the vicinity of the toner supply port 77, a toner filling port 78 is disposed (see FIG. 7).

Subsequently, the barrel part 80 constitutes the most longitudinal part of the container main body 72. The barrel part 80 has its inside formed hollow, and its upper face side is covered by a plane-shaped lid 81 (see FIG. 6). The lid 81 is provided with guide arms 82 and 82 extending along the longitudinal direction of the container main body 72 on the right and left sides thereof, respectively. Each of the guide arms 82 has a height from an upper face 83 to a lower face 84. The height from the upper face 83 to the lower face 84 of each guide arm 82 is constant from the back side to the front side of the container main body 72. The front side of the container main body 72 in the upper face 83 functions as a bearing part 85, which will be described later.

Also, on a lower-side outer peripheral surface forming a bottom portion of the barrel part 80, the key-shaped part 86 is disposed (see FIG. 7). By engaging the key-shaped part 86 with the above-described groove part 67, the driving couplings 62 and 75 are made connectable.

Inside the container main body 72, the toner containing part 87 is formed (see FIG. 5), and in the toner containing part 87, the toner to be supplied to the developing device 21*g* is accommodated. In the toner containing part 87, a screw member 88 is arranged.

The screw member 88 is composed of a shaft part 88*a* that is rotatable and extends in the longitudinal direction of the container main body 72, and a spiral-shaped blade part 88*b* formed around the shaft part 88*a*. When seen from the insertion direction of the toner container 70, the rear end side of the shaft part 88*a* is rotatably supported by the inner face of the handle engagement part 89. On the other hand, the distal end side of the shaft part 88*a* is connected to the driving coupling 75 on the container main body 72 side.

If a decrease in a toner amount in the developing device 21*g* is detected in the controller 18, the shaft part 88*a* is rotated by power from the driving couplings 62 and 75. If the blade part 88*b* is rotated by the rotation of the shaft part 88*a*, the toner around the blade part 88*b* is collected toward the toner supply port 77.

Also, the toner container 70 in this embodiment is provided with a handle member 90 in addition to the container main body 72.

The handle member 90 is provided with a covering part 92 formed in a cup shape. The covering part 92 is composed of peripheral wall extending horizontally from an opening portion thereof and a bottom portion on an end portion of the peripheral wall. The handle member 90 is fixed to the container main body 72 by means of engagement between the inner peripheral surface of the peripheral wall constituting the covering part 92 and the outer peripheral surface of the handle engagement part 89 of the container main body 72. Also, on the outer peripheral surface on the lower side of the peripheral wall, a lock part 94 projecting downward is disposed (see FIGS. 5 and 7). The lock part 94 is inserted into the above-described engagement recess part 68 of the apparatus main body 10 similarly recessed downward.

On the outer peripheral surface of the bottom portion of the covering part 92, a grasping part 96 projects toward the front side of the apparatus main body 10 (see FIG. 3). The grasping part 96 is grasped by the user and is used for detaching/attaching of the toner container 70.

As described above, in each toner container 70, component required to be fixed to the apparatus main body 10 is the projection-shaped lock part 94 only, and the lock part 94 is also formed on the handle member 90, which is separate from the longitudinal container main body 72. Thus, the structure of the toner container 70 or particularly the container main body 72 is simplified.

That is because the rail members 40 and 50 of the apparatus main body 10 are provided with components required for fixation of the toner container 70 in addition to the above-described engagement recess part 68 on the container placement surface 64.

Figure 8:
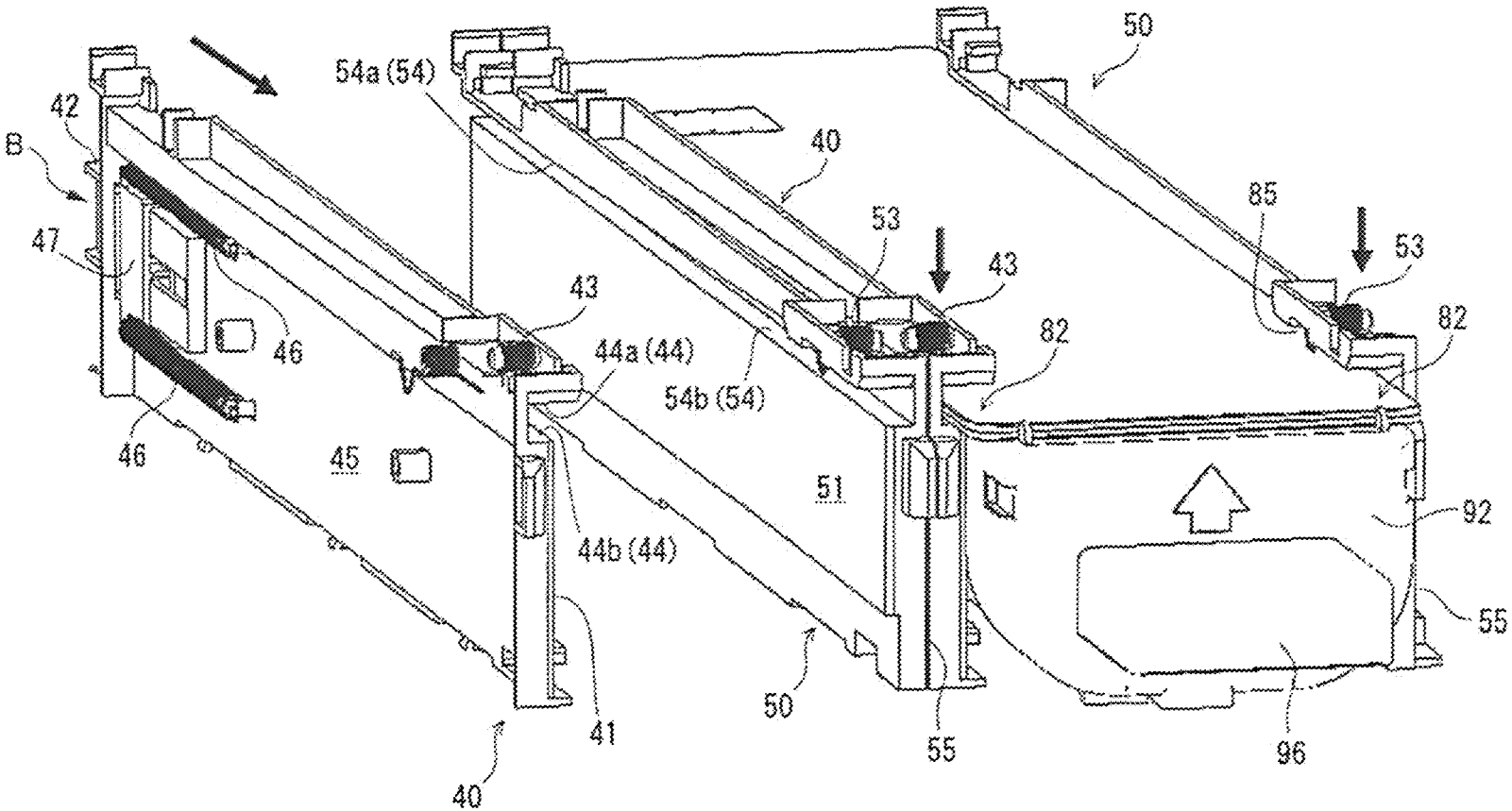
FIG. 8 is an explanatory diagram of rail members in FIG. 4.
Figure 9:
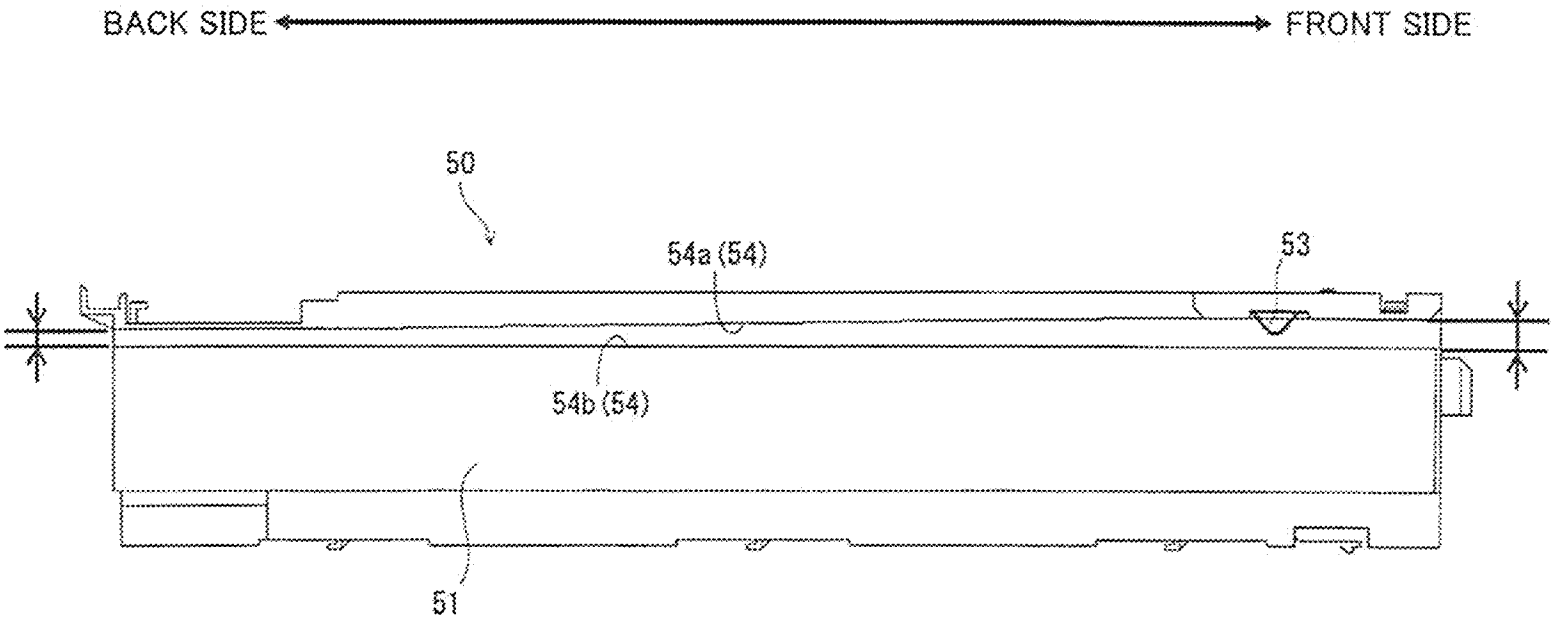
FIG. 9 is a side view of the rail member in FIG. 8.

In more detail, the rail member 50 on the right side extends, as shown in FIGS. 8 and 9, from the back side to the front side of the apparatus main body 10 along the longitudinal direction of the toner container 70. The rail member 50 on the right side has a surface 51 directed to the corresponding toner container 70.

In the surface 51, at a position opposing the guide arm 82 of the toner container 70, a support rail 54 is formed. The support rail 54 has a section in the recess shape in which the surface 51 is recessed in accordance with the shape of the distal end side of the guide arm 82, and its upper face 54*a* is configured so as to be capable of guiding the upper face 83 of the guide arm 82 and its lower face 54*b* is configured so as to be capable of guiding the lower face 84 of the guide arm 82.

Here, as described above, a height of the guide arm 82 from the upper face 83 to the lower face 84 is constant, but a width of the support rail 54 in this embodiment from the upper face 54*a* to the lower face 54*b* is not constant when seen from the insertion direction of the toner container 70.

Specifically, as shown in FIG. 9, the width from the upper face 54*a* to the lower face 54*b* is formed substantially equal to the height of the guide arm 82 from the upper face 83 to the lower face 84 on the back side of the apparatus main body 10 but on the front side of the apparatus main body 10, it is formed larger than the height of the guide arm 82 from the upper face 83 to the lower face 84. That is, the width from the upper face 54*a* to the lower face 54*b* gets gradually smaller as going from the front side to the back side.

Also, on the upper side of the support rail 54, at a position slightly on the back side of the apparatus main body 10 from the inlet of the support rail 54, a downward biasing member (biasing member) 53 is disposed. The downward biasing member 53 biases downward the guide arm 82 with the upper face 83 of the guide arm 82 as the bearing part 85. The downward biasing member 53 may be disposed at a position capable of biasing the lid 81 inside the guide arm 82 downward.

On the side opposite to the surface 51 having the support rail 54 and the downward biasing member 53, a back face 55 is formed (see FIG. 8). The back face 55 opposes a back face 45 of the rail member 40 on the left side with respect to the adjacent toner container 70.

On the other hand, the surface 41 of the rail member 40 on the left side also has a support rail 44 having a recess-shaped section similarly to the surface 51 of the rail member 50. And a width of the support rail 44 from an upper face 44*a* to a lower face 44*b* gets gradually smaller as going from the front side to the back side of the apparatus main body 10. Specifically, the width from the upper face 44*a* to the lower face 44*b* is formed substantially equal to the height from the upper face 83 to the lower face 84 of the guide arm 82 on the back side of the apparatus main body 10, while on the front side of the apparatus main body 10, the width is formed larger than the height of the guide arm 82 from the upper face 83 to the lower face 84 (see FIG. 10A).

Also, at a position slightly on the back side of the apparatus main body 10 from the inlet of the support rail 44, too, a downward biasing member (biasing member) 43 is disposed.

The downward biasing member 43 biases downward the guide arm 82 with the upper face 83 of the guide arm 82 as the bearing part 85.

Figure 10A:
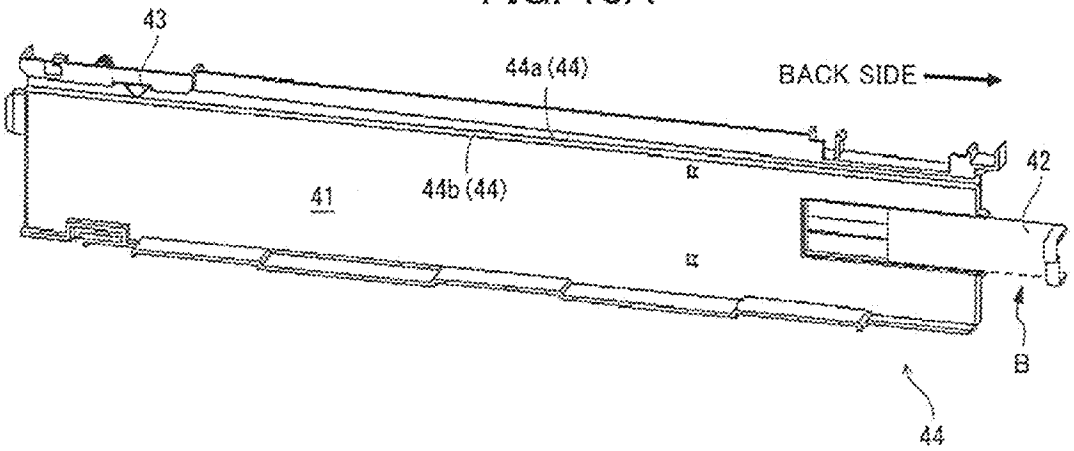
FIG. 10A is a perspective view of the rail member in FIG. 8.
Figure 10B:
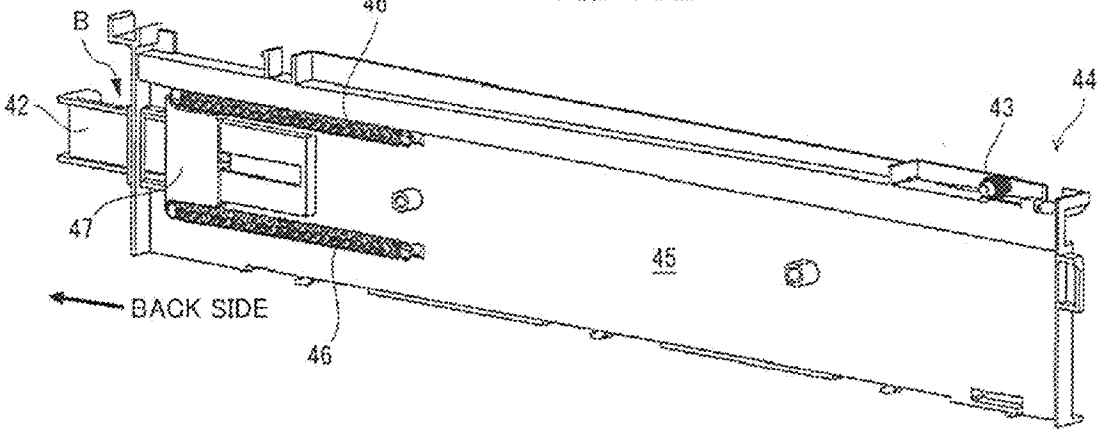
FIG. 10B is a perspective, view of the rail member in FIG. 8.

Here, as shown in FIG. 10A, from the surface 41 of the rail member 40 in this embodiment, a pressing member (replacement promotion mechanism B) 42 is seen.

The pressing member 42 is formed in an L-shape bent toward the surface 51 of the corresponding rail member 50 and is configured so as to be capable of being brought into contact with the insertion distal-end part 74 of the toner container 70. The pressing member 42 of this embodiment is integrally formed on an operation assistance part (replacement promotion mechanism B) 47 on the back face 45 of the rail member 40 (see FIG. 10B). The operation assistance part 47 is connected to a horizontal biasing member (replacement promotion mechanism B) 46 fixed to the back face 45.

As described above, according to this embodiment, the toner container 70 itself can be used as a lock lever using the length from the back side to the front side of the apparatus main body 10.

In more detail, the toner container 70 is provided with the container main body 72 and the handle member 90. And the container main body 72 is constructed substantially in the rectangular solid shape and is horizontally inserted into the apparatus main body 10 along the longitudinal direction thereof.

Also, the container main body 72 has the toner containing part 87 and the barrel part 80. When the toner container 70 is inserted into the apparatus main body 10, first, the insertion distal-end part 74 is brought into contact with the pressing member 42 connected to the horizontal biasing member 46 through the operation assistance part 47. By further inserting the toner container 70 in this insertion direction against the biasing force of the horizontal biasing member 46, the driving coupling 62 and the driving coupling 75 are connected to each other, and the toner containing part 87 is made to communicate with the developing device 21*g* through the toner supply port 77.

At the same time, the guide arm 82 of the barrel part 80 sinks downward upon receipt of the biasing forces from the downward biasing members 43 and 53.

On the other hand, the handle member 90 has the lock part 94 to be inserted into the engagement recess part 68 of the apparatus main body 10. Then, when the lock part 94 is inserted into the engagement recess part 68 by the downward movement of the barrel part 80, the toner container 70 can be fixed to the apparatus main body 10.

As described above, when its insertion distal-end part 74 goes forward along the longitudinal direction of the container main body 72 and the handle member 90 arranged on the rear end side thereof sinks downward along with the container main body 72, the toner container 70 is fixed to the apparatus main body 10. Thus, it is only necessary to dispose the projection-shaped lock part 94 to be inserted into the engagement recess part 68 on the handle member 90 in the toner container 70, which is a consumable supply, and since a lock mechanism using a lever member for lock or an elastic force of a resin as before is no longer necessary, the number of components can be reduced. Also, since the lock part 94 is engaged only with the engagement recess part 68, there is no concern about deformation or breakage.

Also, the apparatus main body 10 has the support rails 44 and 54. And the support rails 44 and 54 are formed having the widths substantially equal to the height from the upper face 83 to the lower face 84 of the guide arm 82 on the back side of the apparatus main body 10 when seen from the insertion direction of the toner container 70. As a result, the driving couplings 62 and 75 can be connected without loosening and the shutter 76 and the shutter opening part 65 can be also brought into contact without loosening. On the other hand, the support rails 44 and 54 have the widths formed larger than the height from the upper face 83 to the lower face 84 of the guide arm 82 on the front side of the apparatus main body 10. As a result, on the front side of the apparatus main body 10, since an angular width that the longitudinal toner container 70 moves in the vertical direction is widened, a lock operation can be performed. As a result, prevention of loosening and operability of the toner container 70 can be both realized.

Moreover, the apparatus main body 10 has the downward biasing members 43 and 53 and the engagement recess part 68. And the downward biasing members 43 and 53 reliably move the barrel part 80 downward. Also, according to the downward movement of the barrel part 80, the lock part 94 is inserted into the engagement recess part 68, and the toner container 70 is reliably fixed to the apparatus main body 10. As described above, since the members required for fixation of the toner container 70, are disposed in the apparatus main body 10, the number of components in the toner container 70, which is a consumable supply, can be reduced more reliably.

Still further, in the covering part 92, an upward arrow is engraved (see FIGS. 3, 4, and 6). If the user applies a force to the grasping part 96 in this arrow direction and moves the handle member 90 upward against the biasing forces of the downward biasing members 43 and 53, the engagement recess part 68 and the lock part 94 are disengaged.

Here, the apparatus main body 10 has a replacement promotion mechanism B so as to prompt an operation by the user.

In more detail, the replacement promotion mechanism B has the pressing member 42, the horizontal biasing member 46, and the operation assistance part 47, and with disengagement between the engagement recess part 68 and the lock part 94 (cancellation of insertion of the lock part 94 into the engagement recess part 68), the toner container 70 can be pushed out toward the side opposite to the insertion direction.

More specifically, the pressing member 42 and the operation assistance part 47 push out the insertion distal-end part 74 by the biasing force of the horizontal biasing member 46 toward the front side of the apparatus main body 10.

As a result, the toner container 70 or particularly the handle member 90 protrudes from inside the apparatus main body 10 by several cm toward the user.

As a result, it becomes easier for the user to pull out the toner container 70, and the user can easily withdraw the toner container 70 from the apparatus main body 10 for replacement.

This disclosure is not limited to the above embodiment and is capable of various changes within a range not departing from the scope of the claims.

For example, in the above embodiment, the example of the projection-shaped lock part 94 and the recess-shaped engagement recess part 68 was described, but as a configuration that can prevent deformation or breakage of the lock part 94, the recess-shaped lock part and the projection-shaped apparatus main body side may be combined.

Also the above-described MFP 4 is an example of the image forming apparatus, and this disclosure can be naturally applied to a copier, a printer, a facsimile machine and the like.

And in any case, similarly to the above, the advantage that the number of components of the toner supply device can be reduced is exerted.

What is claimed is:

1. An image forming apparatus comprising:

a toner supply device configured to be detachably attached into an apparatus main body of said image forming apparatus and to supply a toner to a developing device, wherein said toner supply device comprises:

a container main body configured to be substantially in a rectangular solid shape and to be inserted into said apparatus main body along a longitudinal direction of the container main body, the container main body having a toner containing part communicating with said developing device and a barrel part which moves downward while receiving a biasing force from said apparatus main body when the barrel part is inserted into said apparatus main body; and a handle member arranged at a rear of said barrel part when seen from an insertion direction in which said container main body is inserted, the handle member having a lock part which is configured to be inserted into said apparatus main body according to a downward movement of said barrel part and to fix said toner supply device in said apparatus main body, wherein said barrel part has a hollow part formed inside and said container main body further has a lid covering an upper face of said barrel part;

said lid has a guide arm extending along the longitudinal direction of said container main body; and said apparatus main body has a support rail formed so as to guide an upper face and a lower face of said guide arm, the support rail being configured to have a width substantially equal to a height from said upper face to said lower face on a back side of said apparatus main body when seen in said insertion direction and to have a width larger than the height from said upper face to said lower face on a front side of said apparatus main body.

2. The image forming apparatus according to claim 1, wherein said apparatus main body has a biasing member that biases said lid including said upper face of said guide arm downward on an upper side of said support rail.

3. The image forming apparatus according to claim 2, further comprising an engagement recess part into which said lock part is inserted and which fixes said toner supply device into said apparatus main body.

4. The image forming apparatus according to claim 1, wherein said apparatus main body has a replacement promotion mechanism that, as a result of an upward movement of said handle member, pushes out said toner supply device oppositely with respect to said insertion direction.

5. The image forming apparatus according to claim 4, wherein said replacement promotion mechanism has a pressing member, a horizontal biasing member, and an operation assistance part.

6. The image forming apparatus according to claim 5, wherein said pressing member can be brought into contact with said toner supply device.

7. The image forming apparatus according to claim 2, wherein said apparatus main body has a replacement promotion mechanism that, as a result of an upward movement of said handle member, pushes out said toner supply device oppositely with respect to said insertion direction.

8. The image forming apparatus according to claim 7, wherein said replacement promotion mechanism has a pressing member, a horizontal biasing member, and an operation assistance part.

9. The image forming apparatus according to claim 8, wherein said pressing member can be brought into contact with said toner supply device.

* * * * *